US007304627B2

(12) United States Patent
Kim

(10) Patent No.: US 7,304,627 B2
(45) Date of Patent: Dec. 4, 2007

(54) ALIGNING METHOD UNDER ELECTRIC FIELD OF FERROELECTRIC LIQUID CRYSTAL AND LIQUID CRYSTAL DISPLAY USING THE SAME

(75) Inventor: Hong Chul Kim, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 585 days.

(21) Appl. No.: 10/733,402

(22) Filed: Dec. 12, 2003

(65) Prior Publication Data

US 2004/0119932 A1 Jun. 24, 2004

(30) Foreign Application Priority Data

Dec. 12, 2002 (KR) ..... 10-2002-0079349

(51) Int. Cl.
*G09G 3/36* (2006.01)

(52) U.S. Cl. ..... 345/97

(58) Field of Classification Search ..... 345/87, 345/97; 349/33, 41–42, 49, 191; 359/56
See application file for complete search history.

(56) References Cited

U.S. PATENT DOCUMENTS

| | | | | |
|---|---|---|---|---|
| 4,943,537 | A * | 7/1990 | Harrington, III | 438/217 |
| 5,504,600 | A | 4/1996 | Pirs et al. | |
| 6,015,507 | A | 1/2000 | Kobayashi et al. | |
| 6,108,061 | A | 8/2000 | Sako et al. | |
| 2002/0089485 | A1 * | 7/2002 | Youn | 345/99 |
| 2003/0067579 | A1 * | 4/2003 | Inoue et al. | 349/187 |
| 2004/0119931 | A1 * | 6/2004 | Baek et al. | 349/172 |

* cited by examiner

*Primary Examiner*—Amr A. Awad
*Assistant Examiner*—Stephen G Sherman
(74) *Attorney, Agent, or Firm*—Morgan, Lewis & Bockius LLP

(57) ABSTRACT

An electric field alignment method of liquid crystal display including the steps of: applying a first voltage to a gate terminal of a thin film transistor for driving a liquid crystal cell having ferroelectric liquid crystal, wherein the first voltage is below a threshold voltage of the thin film transistor; and supplying a second voltage for electric field alignment of the ferroelectric liquid crystal to the liquid crystal cell by using leakage current of the thin film transistor generated due to the first voltage.

24 Claims, 14 Drawing Sheets

ALIGNING METHOD UNDER ELECTRIC FIELD OF FERROELECTRIC LIQUID CRYSTAL AND LIQUID CRYSTAL DISPLAY USING THE SAME

The present invention claims the benefit of Korean Patent Application No. P2002-79349 filed in Korea on Dec. 12, 2002, which is hereby incorporated by reference.

BACKGROUND OF THE INVENTION

1. Field of the Invention

The present invention relates to a liquid crystal display, and more particularly to an aligning method under electric field of ferroelectric liquid crystal and a liquid crystal display using the same for alignment restoration.

2. Description of the Related Art

A liquid crystal display applies electric field to the liquid crystal corresponding to the video signal, controls the arrangement state of the liquid crystal, and displays pictures by means of adjusting a light beam transmittance according to the video signal. The liquid crystal display includes a liquid crystal display panel having liquid crystal injected between two glass substrates. The liquid crystal display also includes a light source module or a back light unit for radiating light to the liquid crystal display panel. A structure, such as a frame and chassis, integrally fix the liquid crystal display panel and the light source module as one body. The liquid crystal display further includes a printed circuit board, hereinafter referred to as "PCB", for applying a driving signal to the liquid crystal display panel.

The fabrication process of the liquid crystal display is divided into the steps of substrate cleaning, substrate patterning, substrate bonding, liquid crystal injecting, and drive circuit mounting processes. In the substrate cleaning process, a detergent is used to remove impurities from the surface of a substrate that will be used as the liquid crystal display panel. The substrate patterning process is divided into steps of upper glass substrate patterning and lower glass substrate patterning. On the upper glass substrate of the liquid crystal display panel, a color filter, a common electrode, and a black matrix are formed. On the lower glass substrate of liquid crystal display panel, data lines and gate lines are formed along with a thin film transistor at each intersection of the data and gate lines. Further, a pixel region is defined between the data and gate lines in which a pixel electrode is formed.

The substrate bonding/liquid crystal injecting process includes spreading an alignment film on the substrates of the liquid crystal display panel and rubbing the alignment film. The substrate bonding/liquid crystal injecting process also includes a process of adhering a polarizers on the upper and lower glass substrates. The polarizing directions of the polarizers perpendicularly cross each other. The substrate bonding/liquid crystal injecting process further includes the processes of bonding the upper glass substrate with the lower glass substrate using a sealant, injecting liquid crystal into an injection hole left in the sealant, and sealing the injection hole.

In the driving circuit mounting process, a tape carrier package TCP is connected to a pad part formed on the lower glass substrate. Integrated circuits, such as a gate drive integrated circuit and a data drive integrated circuit are mounted on the tape carrier package TCP. The drive integrated circuit can be directly mounted on the lower glass substrate by a chip on glass (COG) system instead of tape automated bonding system using the TCP described above.

When a liquid crystal display panel is manufactured by such fabrication processes, a module is constructed to have the liquid crystal display panel, the light source module, and the PCB as one body. In the process of constructing such a module, the PCB, the light source module, and the liquid crystal display panel are stacked in the cavity within a main frame, and a top case is constructed to attach to the main frame so that a side of the main frame and the edge of the liquid crystal display panel may be enclosed. In some cases, a bottom case located on the bottom side of the module encloses the bottom surface of the main frame and is also attached to the main frame. Herein, the input terminal of TCP is connected to the output pad of the PCB. The light source module includes a cold-cathode fluorescent lamp and a light guide panel, as well as a prism sheet and a diffusion plate, which are stacked between a light guide panel and a liquid crystal display panel.

The liquid crystal used in the liquid crystal display has a middle state between solid and liquid so as to have fluidity and elasticity at the same time. Up till now, most of the liquid crystal used has twisted nematic TN mode liquid crystal. The TN mode liquid crystal has defects in that its response speed is slow and its viewing angle is narrow. Ferroelectric liquid crystal FLC has the advantages of high response speed and a wide viewing angle.

Ferroelectric liquid crystal has a layer structure in which the electric and the magnetic properties are the same. Ferroelectric liquid crystal is driven in plane and rotates along a virtual cone in response to an electric field. The ferroelectric liquid crystal has a permanent polarization. In other words, spontaneous polarization occurs even though an external electric field is not applied, like an interaction between magnets. If an external electric field is applied, the ferroelectric liquid crystal rotates rapidly because the external electric field quickly counteracts the spontaneous polarization. So the response speed of the ferroelectric liquid crystal is hundred or thousand times faster than that of other modes of liquid crystal. Further, since the ferroelectric liquid crystal has an in-plane-switching property within itself, it can obtain the wide-viewing-angle without a special electrode structure or compensation film. The ferroelectric liquid crystal is classified into the V-Switching Mode and the Half V-Switching Mode according to the characteristic of reacting in response to the polarity of electric field.

FIG. 1 is a graph illustrating voltage vs. transmittance characteristic of ferroelectric liquid crystal of V-Switching mode. In the ferroelectric liquid crystal cell of V-Switching Mode, as the temperature goes down, a thermodynamical phase transition like isotropic→smectic A phase SA→smectic X phase Sm X*→crystal arises. Here, isotropic means the state that the liquid crystal molecules do not have a direction or location order. Smectic A phase means a state that the liquid crystal molecules are divided into virtual layers and are arranged perpendicularly on the virtual layers and have a symmetry in the above and below the virtual layer. The Smectic X phase means the middle state between the smectic A phase and the crystal phase. The ferroelectric liquid crystal cell of V-Switching Mode in which the liquid crystal molecules are transited to the smectic X phase, as shown in FIG. 1, improves the light beam transmittance of incidence light by means of changing the arrangement state, responding to the external voltage of positive polarity +V and the external voltage of negative polarity −V.

The V-Switching Mode has the advantages of a high-speed response and a wide-viewing-angle. However, the V-Switching Mode has the disadvantage of high power usage needed to drive the liquid crystal cell with a high data voltage because the spontaneous polarization value is large, and the capacitance of storage capacitor in order to maintain such a high data voltage is large. Accordingly, if the V-Switching Mode is used in a liquid crystal display, the aperture ratio of the panel is small since the electrode area of an auxiliary capacitor becomes large.

In contrast, the Half V-Switching Mode has the advantages of high-speed-response and wide-viewing-angle. FIG. 2 illustrates a phase transition process of ferroelectric liquid crystal of Half V-Switching mode. The Half V-Switching Mode can be used for displaying moving pictures with a good aperture ratio because the data voltages and capacitances are comparatively low. As shown in FIG. 2, in the Half V-Switching Mode ferroelectric liquid crystal, lowering the temperature below the transition temperature Tni causes a phase transition from isotropic to nematic phase N*. As the temperature goes below the transition temperature Tsn, a phase transition from the nematic phase N* to the smectic C phase Sm C* occurs. Below the transition temperature Tcs, a phase transition from the smectic C phase to crystal occurs. In other words, a thermodynamical phase transition of isotropic-nematic N*→smectic C phase Sm C*→crystal occurs.

FIG. 3 illustrates change of molecule arrangement depending on whether or not electric field alignment of ferroelectric liquid crystal of the Half V-Switching mode has occurred. In FIG. 3, the "ⓧ" represents the electric field direction and the spontaneous polarization direction of the ferroelectric liquid crystal coinciding with the direction toward the drawings from an observer. Ferroelectric liquid crystal is injected into a liquid crystal cell at an incipient temperature such that the liquid crystal is isotropic without direction and location order. If this isotropic temperature is lowered, the ferroelectric liquid crystal becomes nematic phase N* arranged in parallel to the rubbing direction of the alignment film in the cell. While in the nematic phase N*, if the temperature is gradually lowered during the application of sufficient electric field inside liquid crystal cell, the ferroelectric liquid crystal of the nematic phase N* undergoes a phase transition to the smectic phase C* and the spontaneous polarization direction of the ferroelectric liquid crystal is arranged coincidentally with the direction of the electric field formed inside the cell.

As a result of aligning with the electric field, the liquid crystal cell has a spontaneous polarization direction that coincides with the direction of the electric field applied during the electric field alignment such that there is a uniform alignment condition in which layers of the two possible molecule arrangements are all formed in a single direction. On the other hand, without the electric field alignment process, layers of two molecule arrangements having different directions are formed after transiting from the nematic phase N* to the smectic C phase Sm*C. If a random bistable state in which the two molecule arrangements of the ferroelectric liquid crystal have different directions appears, it becomes difficult to control the ferroelectric liquid crystal. Thus, the ferroelectric liquid crystal cell of the Half V-Mode should be arranged to be in a monostable state by means of phase-transiting the ferroelectric liquid crystal from the nematic phase N* to the smectic C phase Sm C* while applying a low DC Voltage and lowering the temperature.

The electric field alignment of the ferroelectric liquid crystal cell of the Half V-Switching Mode is executed after the substrate bonding/liquid crystal injecting process described above. During electric field alignment, the data lines of the liquid crystal display panel are commonly connected to the shorting bar while the gate lines are commonly connected to another shorting bar. A scan voltage, which is more than threshold voltage of a TFT, is applied to the gate lines. A common voltage Vcom is applied to a common electrode of the upper glass substrate. At this time, a direct voltage is applied to the ferroelectric liquid crystal by the common voltage applied to the common electrode and the voltage applied to a pixel electrode through the data lines.

FIG. 4A and FIG. 4B are graphs illustrating the change of light beam transmittance according to the voltage in the ferroelectric liquid crystal cell of the Half V-Switching Mode. Referring to FIG. 4A, in the case of electric field alignment made by the voltage of negative polarity −V or the electric field of negative polarity, the ferroelectric liquid crystal cell of the Half V-Switching Mode makes the incident light beam transmit by means of converting the polarization direction of the incident light beam into 90° only when a positive voltage +V is applied, and makes the incident light beam nearly cut-off by maintaining the polarization direction of the incident light beam in case that the negative voltage −V is applied. The light beam transmittance increases in proportion to the positive electric field intensity and maintains a maximum value if the positive electric field intensity increases to more than the fixed threshold value. In contrast, the ferroelectric liquid crystal cell of the Half V-Switching Mode aligned under an electric field of positive polarity +V, as illustrated in FIG. 4B, makes the incident light beam transmit only in case that negative voltage −V is applied and makes the incident light beam nearly cut-off when a positive voltage +V is applied.

FIGS. 5A and 5B represent a change of a ferroelectric liquid crystal arrangement aligned by negative polarity electric field alignment for a ferroelectric liquid crystal cell of the Half V-Switching Mode and the change of the ferroelectric liquid crystal arrangement when the external electric field of the positive polarity and the negative polarity is applied. As shown in FIG. 5A, if the ferroelectric liquid crystal cell of the Half V-Switching Mode is aligned under electric field by an external electric field of the negative polarity E−, the spontaneous polarization direction Ps of the ferroelectric liquid crystal is aligned uniformly to the direction coinciding with the external electric field of the negative polarity E−. After the electric field is aligned like this, if the external electric field of the positive polarity E+ is applied to the ferroelectric liquid crystal cell of the Half V-Switching Mode, the arrangement of the ferroelectric liquid crystal is changed and the spontaneous polarization direction Ps coincides with the external electric field of the positive polarity E+ (FIG. 5B). At this moment, the polarization direction of the incident light beam from the lower plate of the liquid crystal display is changed to the polarization direction of the polarizer of the upper plate by the ferroelectric liquid crystal and the incident light beam transmits through the polarizer of the upper plate. If the external electric field of the negative polarity E− is applied or the external electric field is not applied to the ferroelectric liquid crystal cell of the Half V-Switching Mode, the arrangement of the ferroelectric liquid crystal maintains the incipient arrangement state and the incident light beam is cut off because the polarization direction is maintained.

The related art ferroelectric liquid crystal cell has a problem in that the original alignment is easily damaged by physical impact because the cell gap is narrow. After the process of the substrate bonding/the liquid crystal injecting, the original electric field alignment is likely to be damaged in the module construction process in which the physical impact is generated frequently. In order to restore the electric field alignment in such a ferroelectric liquid crystal display panel where the original alignment is damaged, the TCP has to be separated from the liquid crystal display panel and the electric field alignment voltage source has to be connected again to the signal wiring with common connections.

SUMMARY OF THE INVENTION

Accordingly, it is an object of the present invention to provide an aligning method under electric field of ferroelectric liquid crystal and a liquid crystal display using the same that are capable of alignment restoration of ferroelectric liquid crystal cell and of aligning ferroelectric liquid crystal cell by using driving circuit used upon normal driving.

In order to achieve these and other objects of the invention, the aligning method under electric field of ferroelectric liquid crystal and the liquid crystal display using the same according to an aspect of the present invention includes the steps of: applying a first voltage to a gate terminal of a thin film transistor for driving a liquid crystal cell having ferroelectric liquid crystal, wherein the first voltage is below a threshold voltage of the thin film transistor; and supplying a second voltage for electric field alignment of the ferroelectric liquid crystal to the liquid crystal cell by using leakage current of the thin film transistor generated due to the first voltage.

In another aspect, an electric field alignment method of ferroelectric liquid crystal display having ferroelectric liquid crystal cells in which a thin film transistor is formed at crossings of data lines and gate lines includes the steps of: supplying a first voltage below a threshold voltage of the thin film transistor to the gate lines; supplying a second voltage to the data lines for electric field alignment of the ferroelectric liquid crystal by using leakage current flowing in the thin film transistor.

In a further aspect, A liquid crystal display includes: a plurality of ferroelectric liquid crystal cells; a plurality of thin film transistors for driving each of the plurality of ferroelectric liquid crystal cells; and an electric field alignment circuit for applying a first voltage below a threshold voltage of the thin film transistor to a gate terminal of the thin film transistor and for aligning the plurality of ferroelectric liquid crystal cells under an electric field by using leakage current of the thin film transistor.

In yet another aspect, a ferroelectric liquid crystal display includes: a liquid crystal panel having ferroelectric liquid crystal cells; data lines and gate lines; thin film transistors for supplying voltage on the data lines to the liquid crystal cells in response to a scan voltage on the gate line; a gate driver for supplying a first a voltage below threshold voltage of the thin film transistor to the gate lines; and a data driver for supplying a second voltage for electric field alignment to the data lines during electric field alignment of the liquid crystal cell.

BRIEF DESCRIPTION OF THE DRAWINGS

These and other objects of the invention will be apparent from the following detailed description of the embodiments of the present invention with reference to the accompanying drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
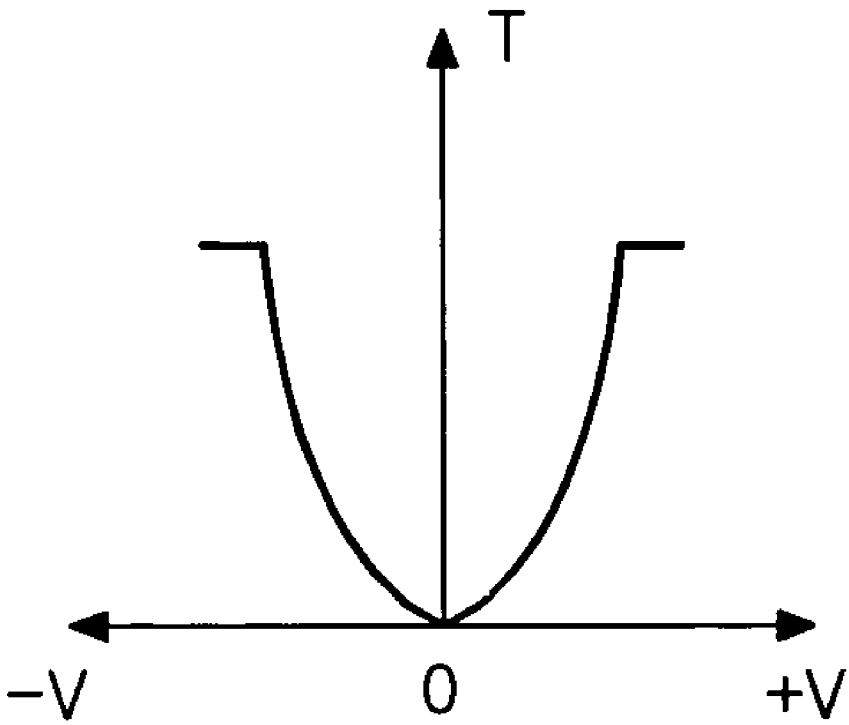
FIG. 1 RELATED ART
FIG. 1 is a graph illustrating voltage vs. transmittance characteristic of ferroelectric liquid crystal of the V-Switching mode.
Figure 2:
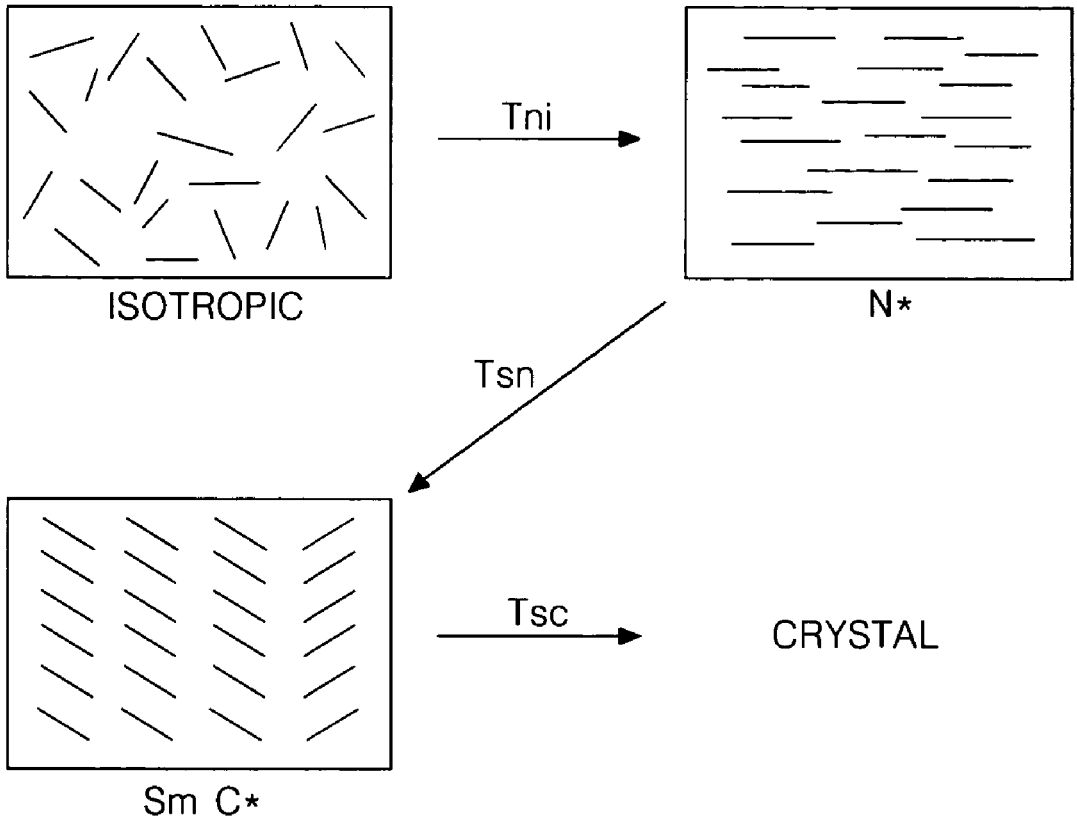
FIG. 2 RELATED ART
FIG. 2 illustrates a phase transition process of ferroelectric liquid crystal of the Half V-Switching mode.
Figure 3:
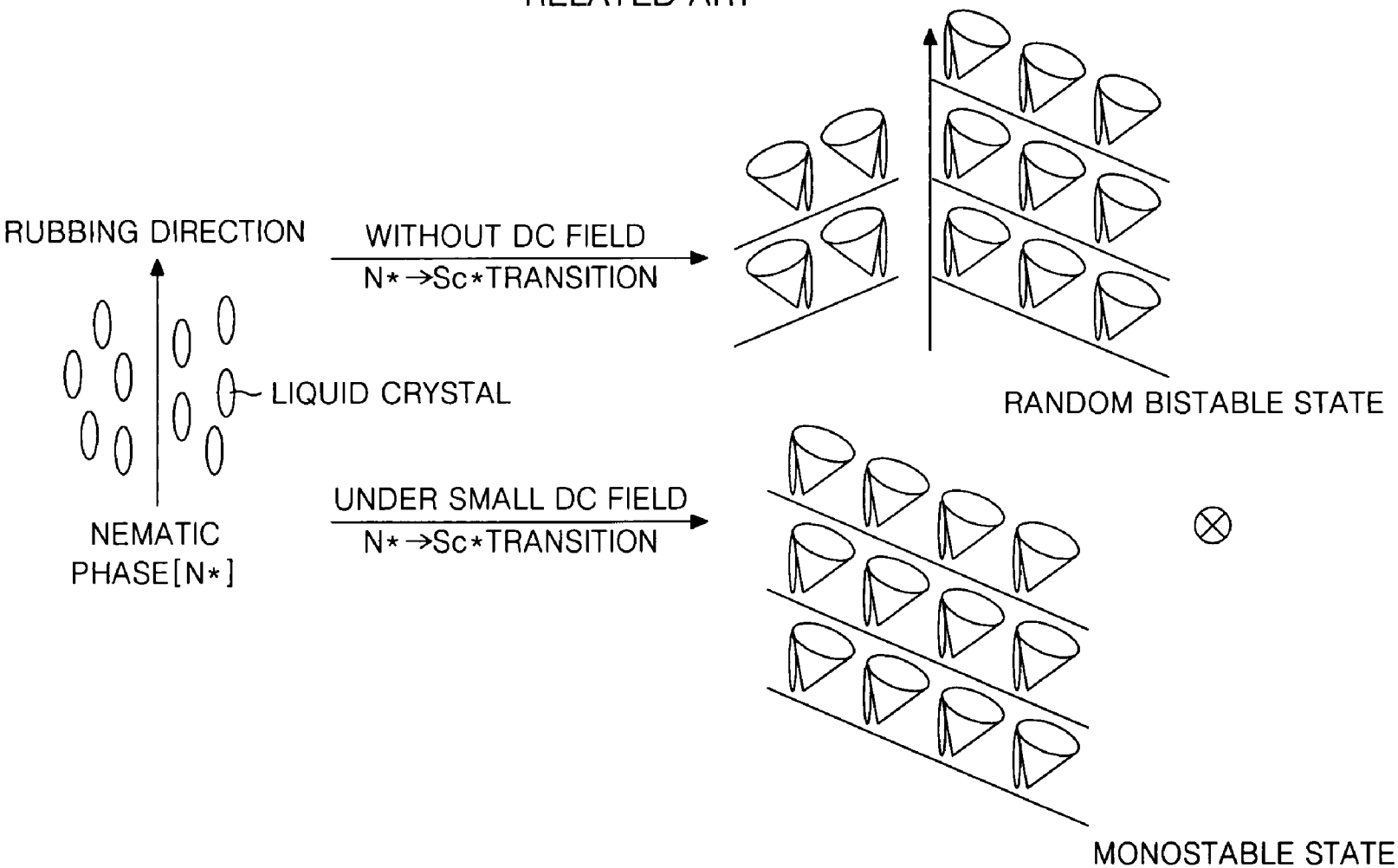
FIG. 3 RELATED ART
FIG. 3 illustrates change of molecule arrangement depending on whether or not electric field alignment of ferroelectric liquid crystal of the Half V-Switching mode has occurred.
Figure 4A:
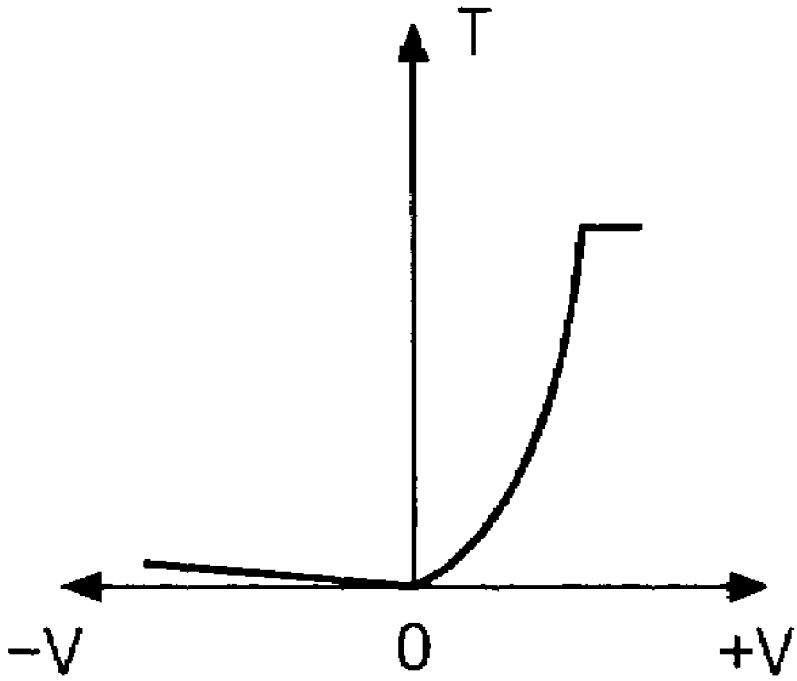
FIG. 4A RELATED ART
FIGS. 4A and FIG. 4B are graphs illustrating the change of light beam transmittance according to the voltage in the ferroelectric liquid crystal cell of the Half V-Switching Mode.
Figure 4B:
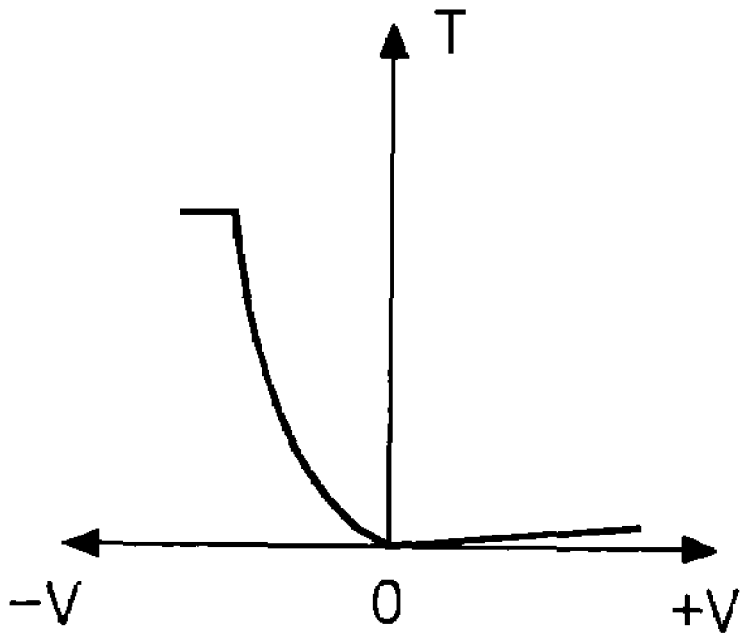
FIG. 4B RELATED ART
Figure 5A:
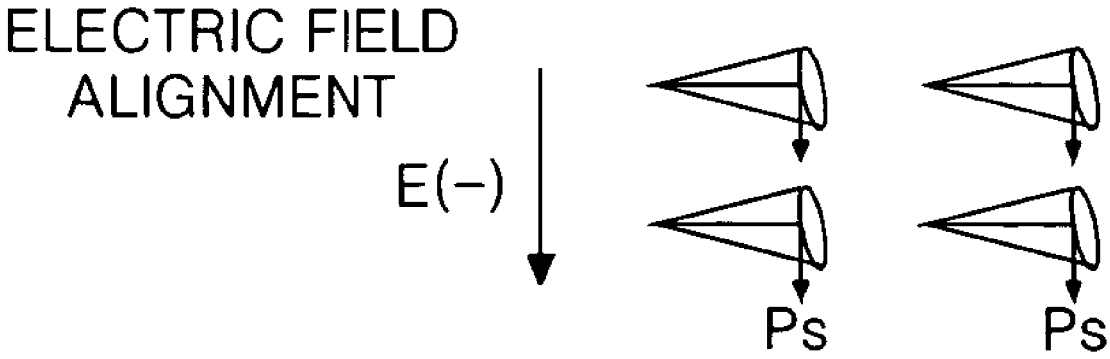
FIG.5A RELATED ART
FIGS. 5A and 5B represent a change of a ferroelectric liquid crystal arrangement aligned by negative polarity electric field alignment for a ferroelectric liquid crystal cell of the Half V-Switching Mode and the change of the ferroelectric liquid crystal arrangement when the external electric field of the positive polarity and the negative polarity is applied.
Figure 5B:
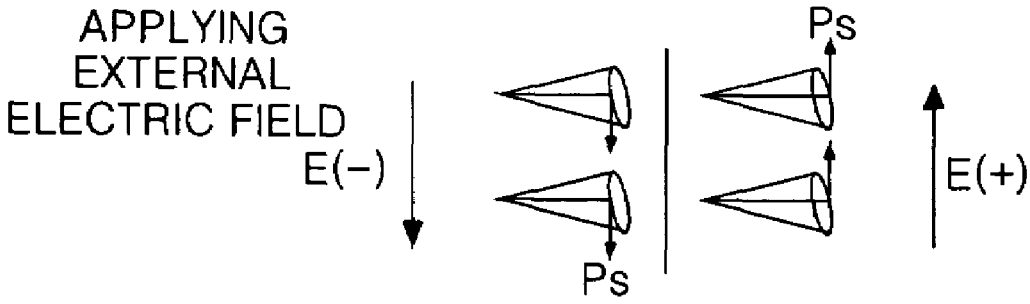
FIG.5B RELATED ART
Figure 6:
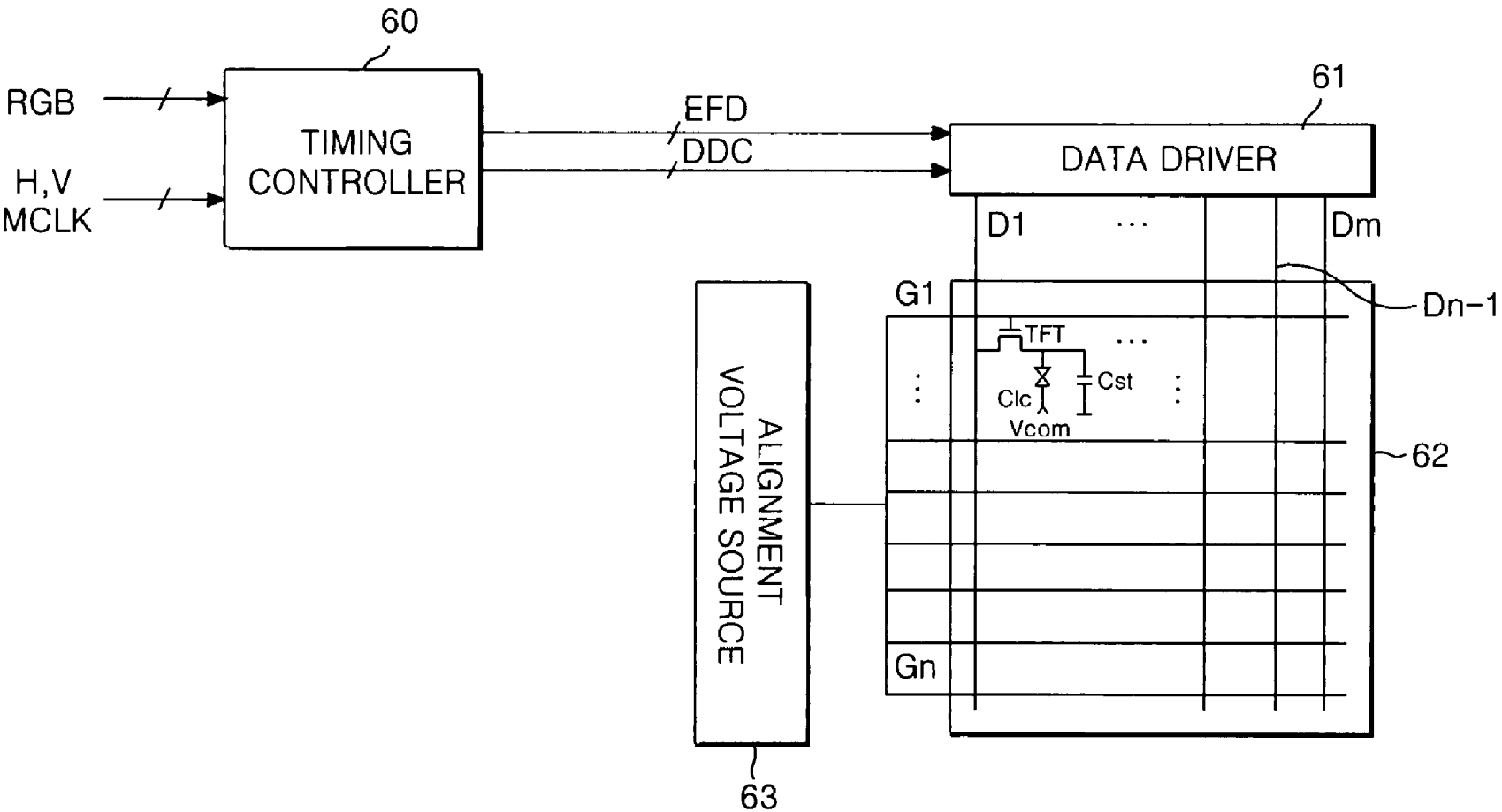
FIG. 6 is a block diagram illustrating a liquid crystal display according to an embodiment of the present invention.

Referring to FIG. 6, the ferroelectric liquid crystal display according to a first embodiment of the present invention comprises a liquid crystal panel 62 in which m×n numbers of liquid crystal cells are arranged in a matrix type, and m numbers of data lines D1 to Dm and n numbers of gate lines G1 to Gn cross each other, TFTs formed at the crossings, a data driver 61 for supplying data to the data lines D1 to Dm of the liquid crystal panel 62, a alignment voltage source 63 for supplying a voltage below threshold voltage of the TFT to the gate lines G1 to Gn, and a timing controller 60 for controlling data driver 61.

In the liquid crystal panel, ferroelectric liquid crystal is inserted between upper and lower glass substrates. The data lines D1 to Dm and gate lines G1 to Gn are formed on the lower glass substrate of the liquid crystal panel 62 so as to cross each other. The gate electrode of the TFTs are connected to the gate lines G1 to Gn, and the source electrodes are connected to the data lines D1 to Dm. The drain electrodes of the TFTs are connected to pixel electrodes of the liquid crystal cells Clc. Further, storage capacitor Cst is formed in each of the liquid crystal cell Clc of the liquid crystal panel. The storage capacitor Cst is formed between the pixel electrode of the liquid crystal cell Clc and an adjacent gate line, or between the pixel electrode of the liquid crystal cell Clc and common electrode line (not shown) to maintain the voltage of the liquid crystal cell Clc.

The alignment voltage source 63 applies a voltage below threshold voltage of the TFTs to the gate lines during alignment with an electric field. If the voltage below threshold voltage of the TFT is applied to the gate electrode of the TFT and a field voltage is applied on the data lines D1 to Dm, a leakage current is generated between the source electrode and the drain electrode so that the field voltage is applied to the pixel electrode of the ferroelectric liquid crystal cell Clc. During normal driving for displaying video data, the alignment voltage source 63 is removed and the gate driving circuit (not shown) for generating scan pulse is connected to the gate lines G1 to Gn. The high logic voltage of the scan pulse generated from the gate driving circuit is more than threshold voltage Vth of the TFTs to thereby turn on the TFTs.

Since the desired leakage current does not flow at the off voltage Voff of the TFT, it is preferable that the alignment voltage source 63 supplies an electric field alignment voltage set at a voltage between the threshold voltage Vth of the TFT and the off voltage Voff of the TFT to the gate lines G1 to Gn. Specifically, since the leakage current of the TFT is very small below 0V and a shock applied to integrated circuit device of the alignment voltage source 63 becomes large above 1V, it is preferable that the voltage supplied to the gate lines G1 to Gn from the alignment voltage source during ferroelectric electric field alignment period is set at about 0 volt to about 1 volt. In other words, it is preferable that the voltage supplied to the gate lines G1 to Gn during electric field alignment period of the ferroelectric liquid crystal is set as about 0%~5% of the threshold voltage Vth of the TFT so as not to overload the TFT when the field voltage is applied.

Figure 7:
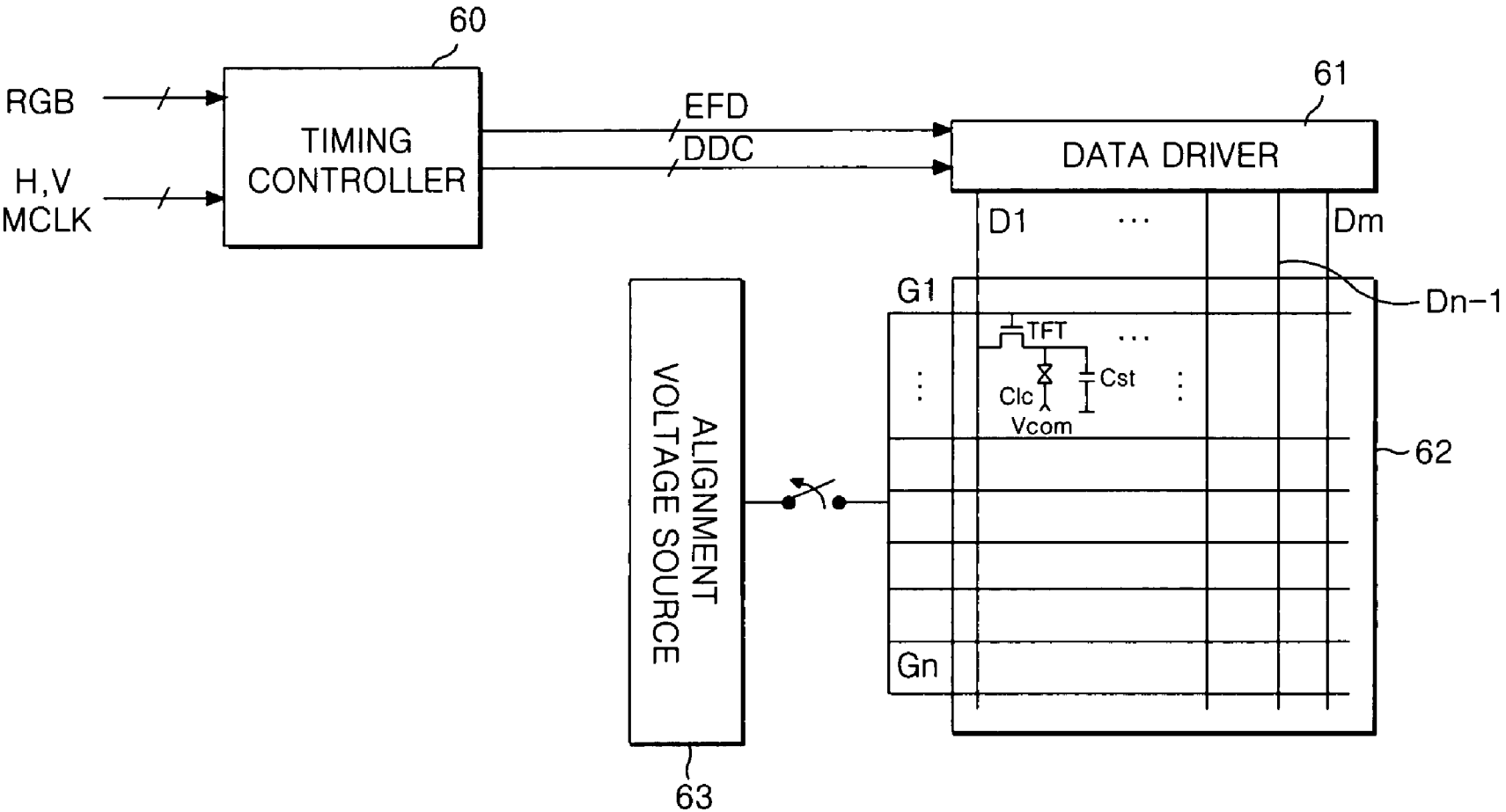
FIG. 7 is a block diagram illustrating a liquid crystal display according to another embodiment of the present invention.

FIG. 7 is a block diagram illustrating a liquid crystal display according to another embodiment of the present invention. As compared to normal driving for displaying video data, the signal power supplied to the gate lines G1 to Gn during electric field alignment is about 90% below normal driving power. Alternatively, as shown in FIG. 7, upon aligning electric field of the ferroelectric liquid crystal, the gate lines G1 to Gn can maintain a floating state in which voltage is not applied directly. In this case, the voltage on the data lines D1 to Dm is supplied to the pixel electrode of the liquid crystal cell by the leakage current of the TFT.

The data driver 61 converts digital electric field alignment data EFD into several volts of analog voltage and supplies the analog voltage to the data lines D1 to Dm in response to data control signal DDC from the timing controller 60. The digital electric field alignment data EFD is set as a value corresponding to an analog voltage necessary for electric field alignment and received from the timing controller 60 or by special data input means from manufacturer upon an initial electric field alignment or restoring the alignment. Further, the data driver 61 supplies alternatingly different polarities to adjacent data lines D1 to Dm during electric field alignment of the ferroelectric liquid crystal. The data driver 61 maintains the polarity of data lines D1 to Dm during electric field alignment of the ferroelectric liquid crystal so that the voltage applied to each ferroelectric liquid crystal cell Clc may be maintained during electric field alignment period of the ferroelectric liquid crystal.

The timing controller 60 supplies the digital electric field alignment data EFD necessary for electric field alignment to the data driver 61 upon aligning the electric field or restoring the alignment to the data driver 61 and generates data control signal DDC for controlling the data driver 61 by using vertical/horizontal synchronization signal V and H, and main clock MCLK. The data control signal DDC comprises a source start pulse GSP, a source shift clock SSC, a source output enable SOE, and a polarity POL. Further, the timing controller 60 supplies the digital video data of a red R, a green G, and a blue B to the data driver 61 upon driving normally and generates data control signal DDC for controlling the data driver 61 and gate control signal not shown for causing a gate driver sequentially to generate scan pulse to thereby control data driver 61 and the gate driver.

Figure 8:
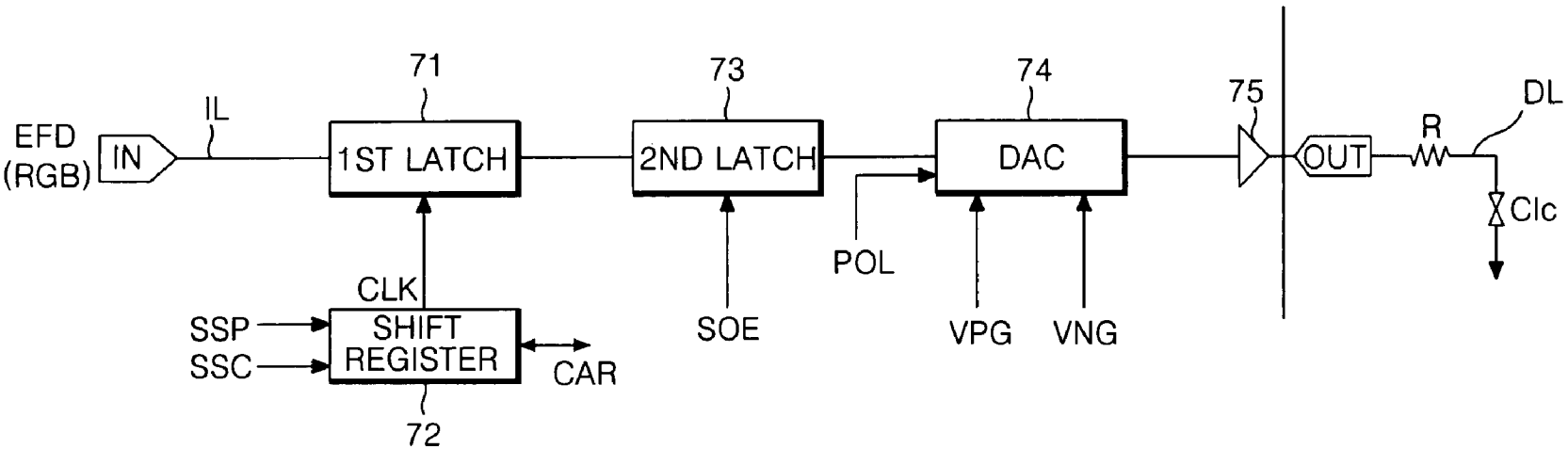
FIG. 8 is a block diagram illustrating the data driving circuit shown in FIGS. 6 and 7.
Figure 9:
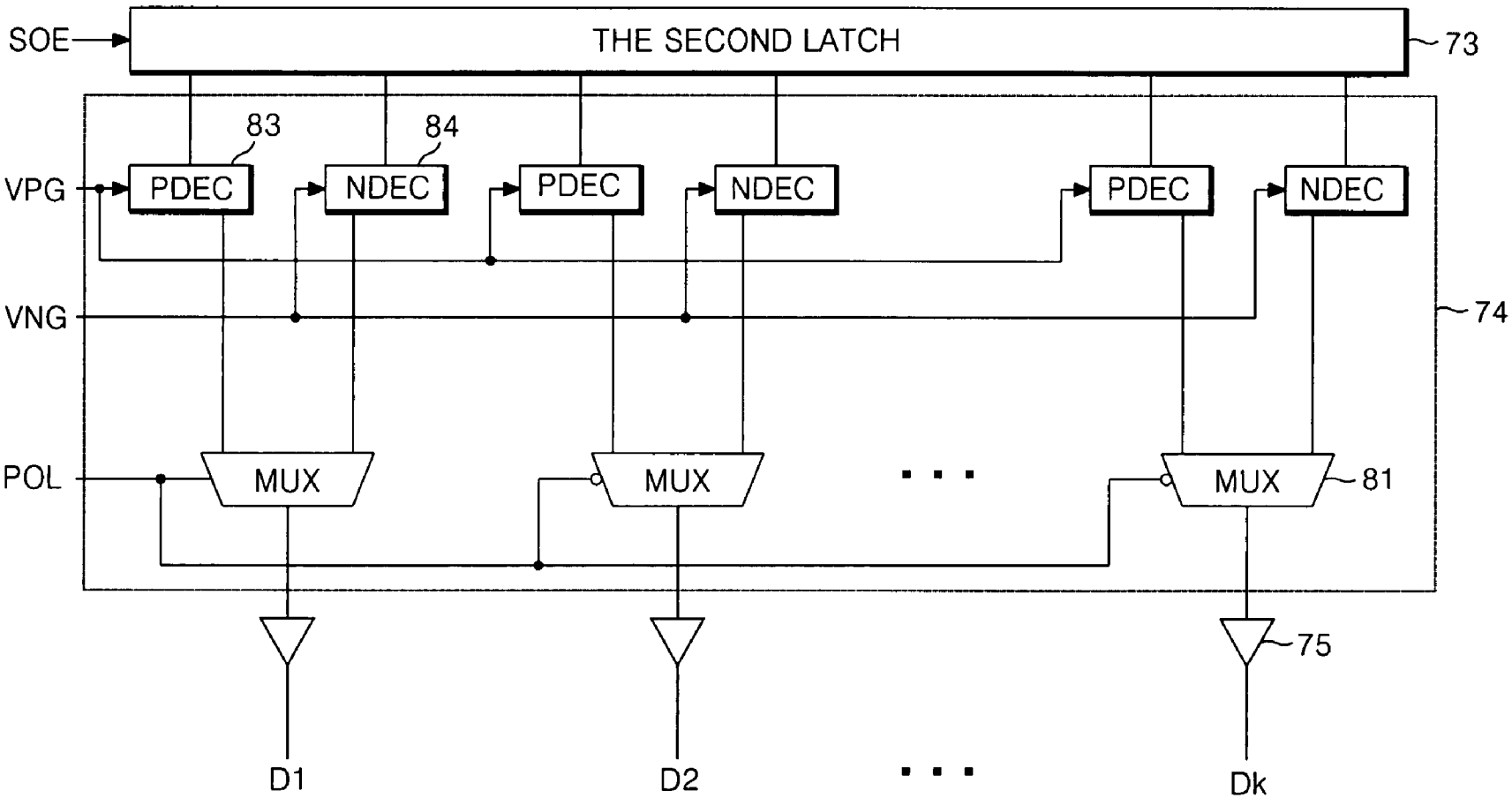
FIG. 9 is a circuit diagram in detail illustrating a digital to analog converter shown in FIG. 8.

FIGS. 8 and 9 in detail illustrate data driver shown in FIG. 6. As shown in FIGS. 8 and 9, the data driver 61 comprises a shift register 72, a first latch 71, a second latch 73, a digital-to-analog converter hereinafter referred to as "DAC" 74 and a buffer 75 connected between input line IL and data line DL. The data driver 61 is integrated as a plurality of source integrated circuits hereinafter referred to as "S-IC" for supplying electric field alignment data EFD or video data RGB respectively to k, which is a positive integer smaller than m numbers of data lines.

The shift register 72 shifts the source start pulse SSP from the timing controller 60 in accordance with source shift clock signal SSC to generate a sampling signal. Further, the shift register 72 shifts the source start pulse SSP to transfer carry signal to prior state of shift register 72. The first latch 71 samples the digital electric field alignment data EFD or the digital video data RGB in accordance with the sampling signal received from the shift register 72, and then if all data EFD (or RGB) are stored in the first latch 71 within another S-ICs, the first latch 71 supplies the stored data. The second latch 73 latches data EFD (or RGB) received from the first latch 71, and then simultaneously supplies one horizontal line of data latched along with another S-IC of the second latch 73 in response to the source output signal SOE from the timing controller 60.

The DAC 74 converts data EFD (or RGB) from the second latch 73 into positive polarity analog gamma voltage VPG or negative analog gamma voltage VNG in accordance with polarity signal POL from the timing controller 60. The voltage generated from the DAC 74 is supplied with column inversion system that is, with mutually contrary polarity to adjacent data lines D1 to D2. For example, while positive polarity or negative polarity of voltage is supplied to odd-numbers of data lines D1, D3, . . . ,Dm−1, negative polarity or positive polarity of voltage is supplied to even numbers of data lines D2, D4, . . . , Dm. The buffer 75 functions to supply analog gamma voltage VPG (or VNG) received from the DAC 74 without signal attenuation to the data lines D1 to Dm.

As shown in FIG. 8, the DAC 74 of the data driver 61 comprises a P-decoder PDEC 83 for converting data EFD (or RGB) from the second latch 73 for supplying mutually contrary polarity of voltage to adjacent data lines D1 to Dm into positive polarity analog gamma voltage VPG, a N-decoder NDEC 84 for converting data EFD and RGB from the second latch 73 into negative polarity analog gamma voltage VNG, and a multiplexer 81 for selecting any one of outputs of the P-decoder PDEC 83 and N-decoder PDEC 84. Each of the multiplexers 81 selects output of the P-decoder 83 when the polarity signal POL is high logic value, and selects output of the N-decoder 84 when the polarity signal POL is low logic value. Herein, while the multiplexer 81 connected to odd-numbered data lines D1, D3, . . . , Dm−1 selects the output of the P-decoder 83 and the output of the N-decoder 84 in response to non-inversion signal of the polarity signal POL, the multiplexer 141 connected to even-numbered data lines D2, D4, . . . , Dm selects the output of the P-decoder 83 and the output of the N-decoder 84 in response to inversion signal of the polarity signal POL. Accordingly, the voltage of alternatingly different polarities are supplied to the odd-numbered data lines D1, D3, . . . , Dm−1 and the even-numbered data lines D2, D4, . . . ,Dm.

While the ferroelectric liquid crystal is aligned under the electric field, the source output signal SOE maintains special logic value making the second latch 73 direct the output of the data for example, high logic. At the same time, the polarity signal POL maintains special logic so that the polarity of the voltage supplied to the odd-numbered data line D1, D3, . . . ,Dm−1 may be maintained and the polarity of the voltage supplied to the even-numbered data line D2, D4, . . . , Dm may be maintained.

Figure 10:
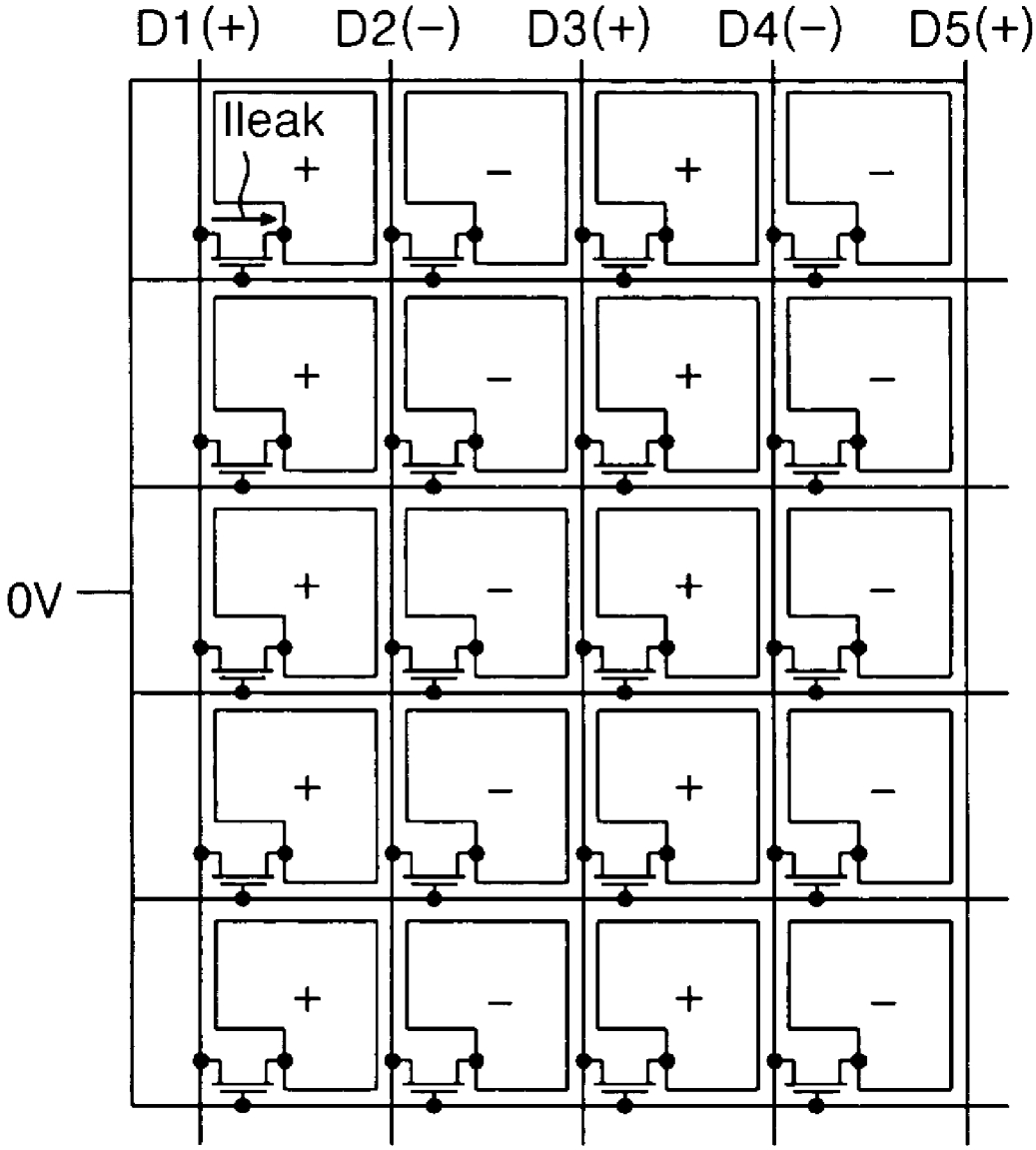
FIGS. 10 and 11 illustrate a polarity of voltage charged to liquid crystal cell when voltage of mutually contrary polarity is supplied to adjacent data lines during electric field alignment period.

Accordingly, while the ferroelectric liquid crystal is aligned under electric field, the polarity of the voltage supplied to odd-numbered data line D1, D3, . . . , Dm−1 and even-numbered data line D2, D4, . . . , Dm is contrary to each other, and the voltage supplied respectively to odd-numbered data line D1, D3, Dm−1 and even-data line D2, D4, . . . , Dm is uniformly maintained. For example, during electric field alignment period of ferroelectric liquid crystal, as shown in FIG. 10, the positive polarity of the voltage is uniformly supplied to odd-numbered data lines D1, D3, . . . , Dm−1 and the negative polarity of the voltage is uniformly supplied to the even-numbered data lines D2, D4, . . . ,Dm. In the alternative, during electric field alignment of ferroelectric liquid crystal, as shown in FIG. 11, the negative polarity of the voltage can be uniformly supplied to odd-numbered data lines D1, D3, . . . , Dm−1 and the positive polarity of the voltage can be uniformly supplied to the even-numbered data lines D2, D4, . . . ,Dm.

Figure 11:
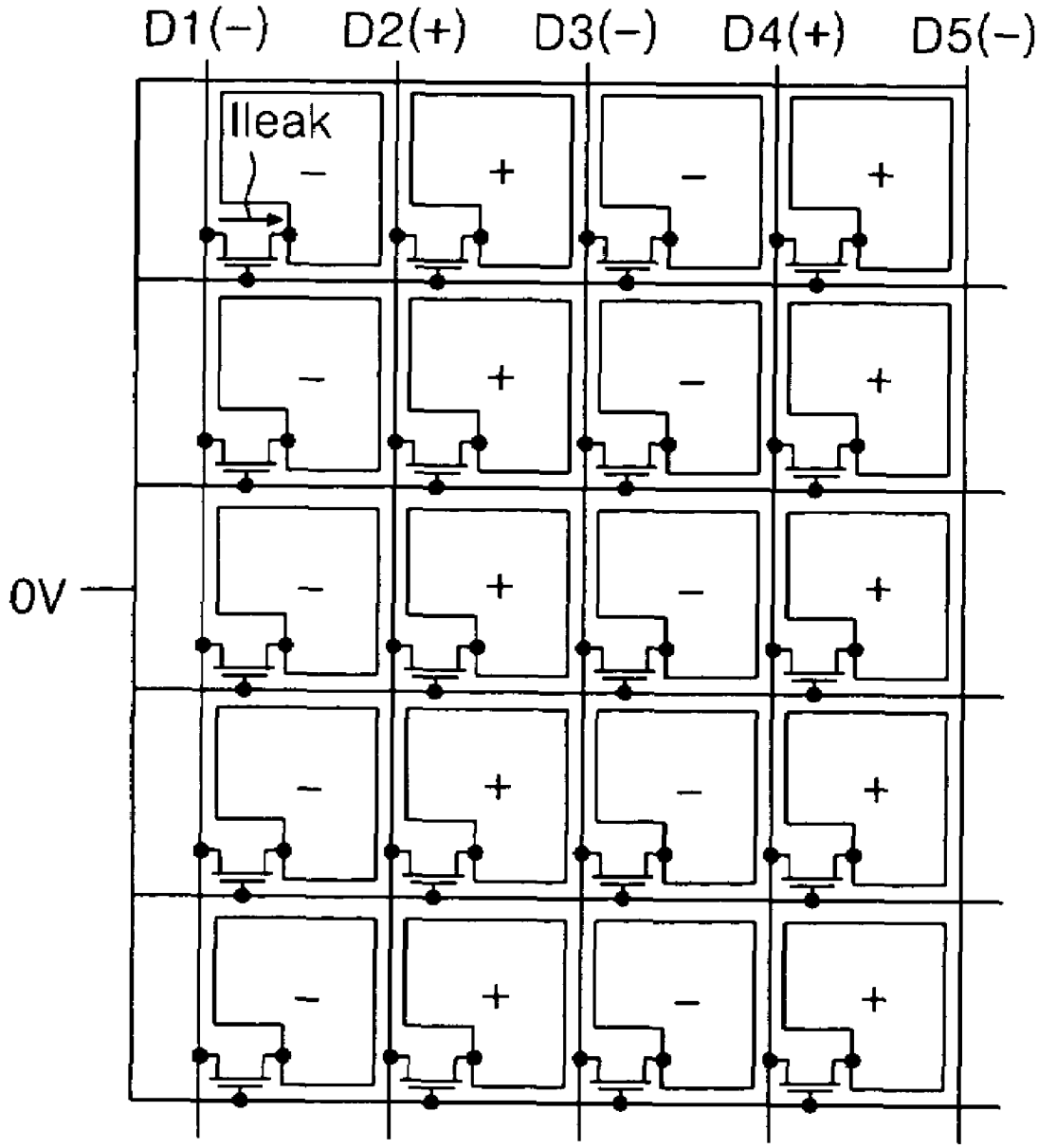

During electric field alignment, the voltage supplied to the data lines D1 to Dm, as shown in FIG. 10 or 11, is supplied to the pixel electrode of the ferroelectric liquid crystal cell Clc by the leakage current of the TFT. Alternatingly different polarities of electric field are applied to adjacent ferroelectric liquid crystal cell Clc in the gate line direction and the electric field of mutually same polarity of electric field is applied to adjacent ferroelectric liquid crystal cell Clc in the data line direction. The polarity of the electric field respectively supplied to the ferroelectric liquid crystal cells Clc is uniformly maintained.

Figure 12:
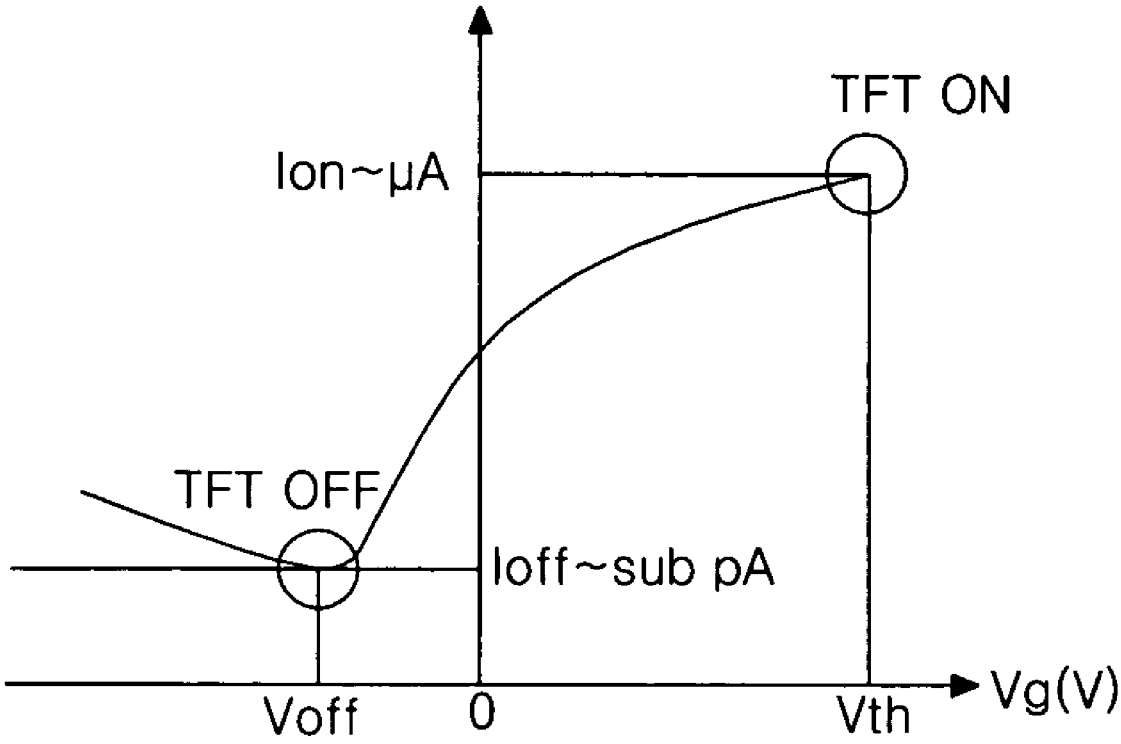
FIG. 12 is a graph illustrating current characteristics between the source and the drain of thin film transistor TFT according to the gate voltage.

FIG. 12 illustrates current characteristic between the source and the drain in accordance with the gate voltage of the TFT. As shown in FIG. 12, if the voltage more than threshold voltage Vth of the TFT is applied to the gate electrode of the TFT, the TFT is turned-on and thereby a current path is formed between source electrode and drain electrode of the TFT. When the threshold voltage Vth of the TFT is about 20 volts, if the threshold voltage Vth of the TFT is applied to the gate electrode of the TFT, the current of about μA unit flows between the source electrode and the drain electrode of the TFT. On the other hand, if the OFF voltage of the TFT is applied to the gate electrode of the TFT, the current path is nearly cut off between the source electrode and the drain electrode of the TFT and only a minute leakage current $I_{OFF}$ flows. When the OFF voltage of the TFT is about −5V, only leakage current below a picoamp (pA) unit flows between the source electrode and the drain electrode of the TFT.

The electric field alignment method of the ferroelectric liquid crystal display according to the present invention exposes the ferroelectric liquid crystal to a temperature below the phase transition temperature Tsn; and during the required period in which the ferroelectric liquid crystal cell undergoes a phase transition from nematic phase N* to smectic C phase Sm C*, supplies the voltage between the threshold voltage Vth of the TFT and the OFF voltage Voff of the TFT to the gate lines G1 to Gm; and at the same time uniformly supplies alternatingly different polarities of voltage to the adjacent data lines D1 to Dn during electric field alignment period to thereby supply the voltage necessary for electric field alignment to the ferroelectric liquid crystal cell.

As described above, the aligning method under electric field of the ferroelectric liquid crystal and the liquid crystal display using the same according to the embodiments of the present invention applies voltage to the data lines by using a column inversion system of data driver in the instant of initial electric field alignment of the ferroelectric liquid crystal cell or alignment restoration, and applies voltage below threshold voltage of the TFT and above the off voltage of the TFT to the gate electrode of the TFT connected to the pixel electrode of the ferroelectric liquid crystal cell to thereby apply suitable voltage for electric field alignment to the ferroelectric liquid crystal cell. As a result, the aligning method under electric field of the ferroelectric liquid crystal and the liquid crystal display using the same according to embodiments of the present invention are capable of alignment restoration of the ferroelectric liquid crystal cell and can align the ferroelectric liquid crystal cell by using driver used for normal driving.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents

What is claimed is:

1. An electric field alignment method of liquid crystal display, comprising the steps of:

applying a first voltage to a gate terminal of a thin film transistor for driving a liquid crystal cell having ferroelectric liquid crystal, wherein the first voltage is below a threshold voltage of the thin film transistor; and supplying a second voltage for electric field alignment of the ferroelectric liquid crystal to the liquid crystal cell by using leakage current of the thin film transistor generated due to the first voltage, wherein the second voltage has uniformly maintained polarity and is applied to a source terminal of the thin film transistor such that the second voltage is supplied from the source terminal to a pixel electrode of the liquid crystal cell via leakage current of the thin film transistor to a drain terminal of the thin film transistor that is connected to the pixel electrode.

2. The method according to claim 1, wherein the liquid crystal cell is a Half V-Switching mode ferroelectric liquid crystal cell.

3. The method according to claim 1, wherein the first voltage is between about −5 volts to about 20 volts.

4. The method according to claim 1, wherein the first voltage is between about 0 volt to 1 volt.

5. The method according to claim 1, wherein the first voltage is floating.

6. An electric field alignment method of ferroelectric liquid crystal display having ferroelectric liquid crystal cells in which a thin film transistor is formed at crossings of data lines and gate lines, comprising the steps of:

supplying a first voltage below a threshold voltage of the thin film transistor to the gate lines;

supplying a second voltage to the data lines for electric field alignment of the ferroelectric liquid crystal by using leakage current flowing in the thin film transistor;

wherein voltages of mutually contrary polarity are applied to the data lines, wherein the polarity of voltage supplied to each of the data lines is uniformly maintained during electric field alignment of the ferroelectric liquid crystal cells.

7. The method according to claim 6, further comprising the step of:

supplying video data to the data lines during normal driving of the liquid crystal display.

8. The method according to claim 6, further comprising the step of:

supplying scan voltage set to more than the threshold voltage of the thin film transistor to the gate lines during normal driving of the liquid crystal display.

9. The method according to claim 6, wherein the liquid crystal cell is a Half V-Switching mode ferroelectric liquid crystal cell.

10. The method of according to claim 6, wherein the first voltage is between about −5 volts to about 20 volts.

11. The method according to claim 6, wherein the first voltage is 0 volt to about 1 volt.

12. The method according to claim 6, wherein the first voltage is floating.

13. A liquid crystal display, comprising:

a plurality of ferroelectric liquid crystal cells;

a plurality of thin film transistors for driving each of the plurality of ferroelectric liquid crystal cells; and an electric field alignment circuit for applying a first voltage below a threshold voltage of the thin film transistor to a gate terminal of the thin film transistor and for aligning the plurality of ferroelectric liquid crystal cells under an electric field by using leakage current of the thin film transistor, wherein a second voltage having uniformly maintained polarity is applied to a source terminal of the thin film transistor such that the second voltage is supplied from the source terminal to a pixel electrode of the liquid crystal cell via leakage current of the thin film transistor to a drain terminal of the thin film transistor that is connected to the pixel electrode.

14. The liquid crystal display according to claim 13, wherein the plurality of liquid crystal cells are Half V-switching mode ferroelectric liquid crystal cells.

15. The liquid crystal display according to claim 13, wherein the first voltage is between about −5 volts to about 20 volts.

16. The liquid crystal display according to claim 13, wherein the first voltage is between 0 volt and 1 volt.

17. The liquid crystal display according to claim 13, wherein the first voltage is floating.

18. A ferroelectric liquid crystal display, comprising:

a liquid crystal panel having ferroelectric liquid crystal cells;

data lines and gate lines;

thin film transistors for supplying voltage on the data lines to the liquid crystal cells in response to a scan voltage on the gate line;

a gate driver for supplying a first a voltage below threshold voltage of the thin film transistor to the gate lines; and a data driver for supplying a second voltage, by using leakage current of the thin film transistor generated due to the first voltage, for electric field alignment to the data lines during electric field alignment of the liquid crystal cell, wherein the data driver supplies a second voltage for electric field alignment to the data lines by column inversion method during electric field alignment of the ferroelectric liquid crystal, wherein the polarity of voltage supplied to each of the data lines is uniformly maintained during electric field alignment of the ferroelectric liquid crystal.

19. The ferroelectric liquid crystal display according to claim 18, wherein the data driver supplies video data to the data lines by column inversion method during normal driving of the liquid crystal display.

20. The ferroelectric liquid crystal display according to claim 18, wherein the gate driver supplies scan voltages above the threshold voltage of the thin film transistors to the gate lines during normal driving of the liquid crystal display.

21. The ferroelectric liquid crystal display according to claim 18, wherein the liquid crystal cell is a Half V-Switching mode ferroelectric liquid crystal cell.

22. The ferroelectric liquid crystal display according to claim 18, wherein the first voltage is between about −5 volts to about 20 volts.

23. The ferroelectric liquid crystal display according to claim 18, wherein the first voltage is between 0 volt and 1 volt.

24. The ferroelectric liquid crystal display according to claim 18, wherein the first voltage is floating.

* * * * *